US006648498B1

(12) United States Patent
Tsao

(10) Patent No.: US 6,648,498 B1
(45) Date of Patent: Nov. 18, 2003

(54) LIGHT STRING COMPOSED OF LIGHT EMITTING DIODES

(76) Inventor: Chia-Tsung Tsao, 1F, No. 606, Sec. 1, Nei Hu Rd., Taipei (TW)

( * ) Notice: Subject to any disclaimer, the term of this patent is extended or adjusted under 35 U.S.C. 154(b) by 0 days.

(21) Appl. No.: 10/176,245

(22) Filed: Jun. 20, 2002

(51) Int. Cl.[7] ..... F21V 17/06

(52) U.S. Cl. ..... 362/800; 362/375; 315/185 R

(58) Field of Search ..... 315/185 R, 193; 362/800, 368, 375

(56) References Cited

U.S. PATENT DOCUMENTS 5,400,229 A * 3/1995 Lin ..... 362/235

* cited by examiner

*Primary Examiner*—David Vu
(74) *Attorney, Agent, or Firm*—Jackson Walker L.L.P.

(57) ABSTRACT

A light string is composed of multiple light emitting units. Each light emitting unit utilizes multiple LEDs as the light emitting source to generate various light colors for enriching visual effects. Further, the light string is able to adhere to form any particular configuration as an attractive advertising device. By using the LEDs as the light source, power consumed by the light string is very low and operators of the light string are not exposed to high voltages.

13 Claims, 6 Drawing Sheets

LIGHT STRING COMPOSED OF LIGHT EMITTING DIODES

BACKGROUND OF THE INVENTION

1. Field of Invention

The present invention relates to a light string, and more particularly to a light string made up of multiple light emitting diodes for self-assembly by a user.

2. Related Art

Generally speaking, most conventional advertising devices utilize the neon light as the light emitting sources. For example, with reference to FIG. 7, a conventional advertising device is constituted by several neon lights (A)–(D) each with a specific shape to form a letter "A". Such a neon light advertising device has multiple defects that need to be improved.

1. Each neon light (A)–(D) in the advertising device needs to cooperate with a voltage transformer for the tube activation. However, a complete advertising device is usually composed of tens of the neon lights. Correspondingly, the cost for the total amount of the transformer is extremely high for the advertiser. Further, in order to form the advertising device with a particular configuration, the shape of each light is made specially and fabricated by a professional, which causes further high costs in manufacture and maintenance.

2. Since each tube (A)–(D) is activated by the high voltage generated by transformer, the insulation protection against the damage from high voltage must be well established. Furthermore, since the volume of the transformer and the neon lights will occupy significant space, that equipment is difficult to transport. Additionally, the lights themselves are very fragile which leads to an expensive high failure rate.

3. By applying the high voltage to activate the neon lights, the average using life of a neon light only has thousands of hours. Such an advertising device may be often need to be repaired after the installation. Meanwhile, the new light tube for replacing the damaged one needs to be pre-fabricated because of its particular shape.

To overcome the shortcomings, a light string composed of light emitting diodes in accordance with the present invention obviates or mitigates the aforementioned problems.

SUMMARY OF THE INVENTION

The primary objective of the light string composed of light emitting diodes in accordance with the present invention is to provide a light string that allows a user to construct any lighting device with a particular shape for the advertising purposes.

Other objects, advantages and novel features of the invention will become more apparent from the following detailed description when taken in conjunction with the accompanying drawings.

DETAILED DESCRIPTION OF THE INVENTION

Figure 1:
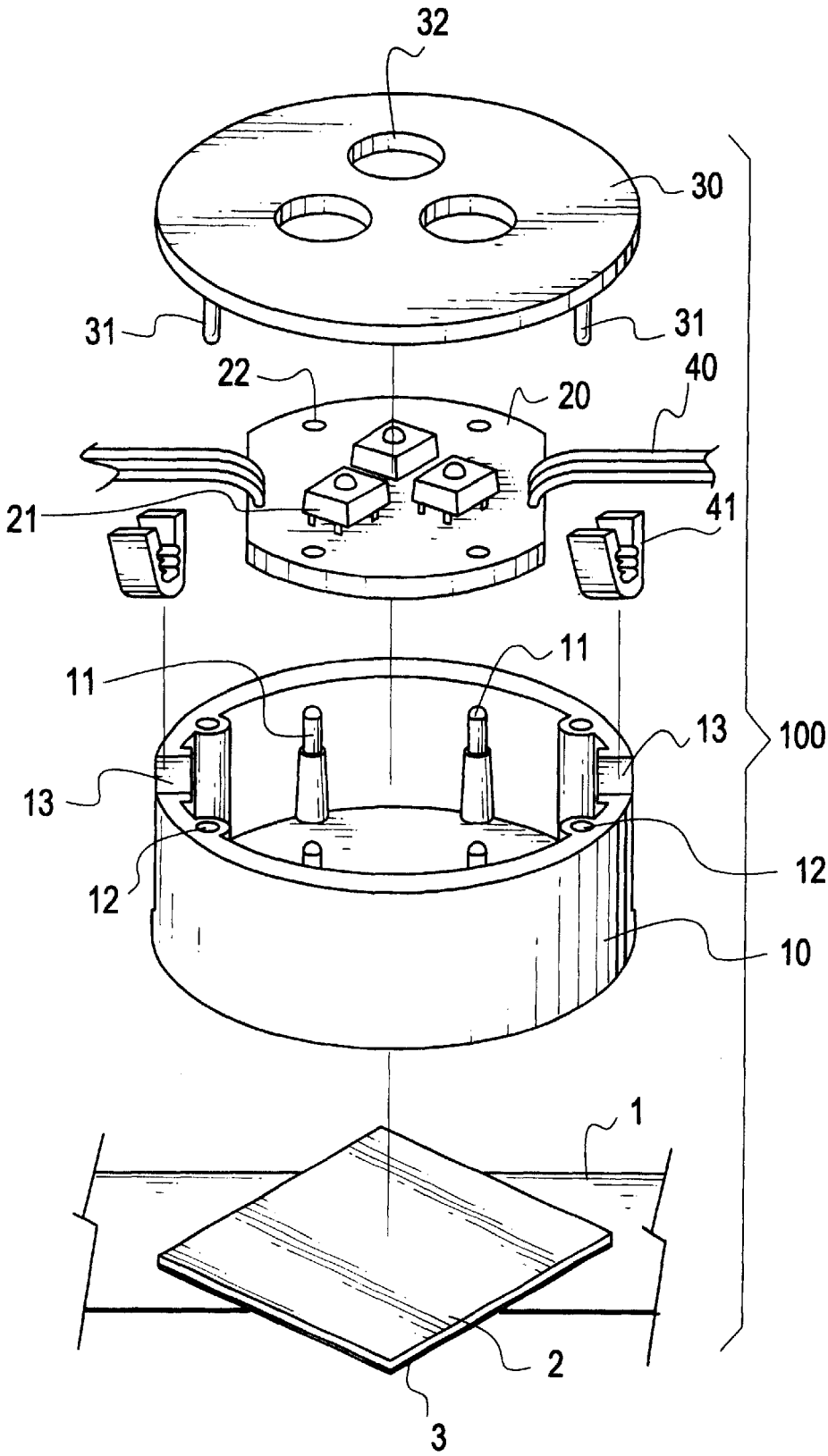
FIG. 1 is an exploded perspective view of a single light emitting unit in accordance with the present invention.
Figure 4:
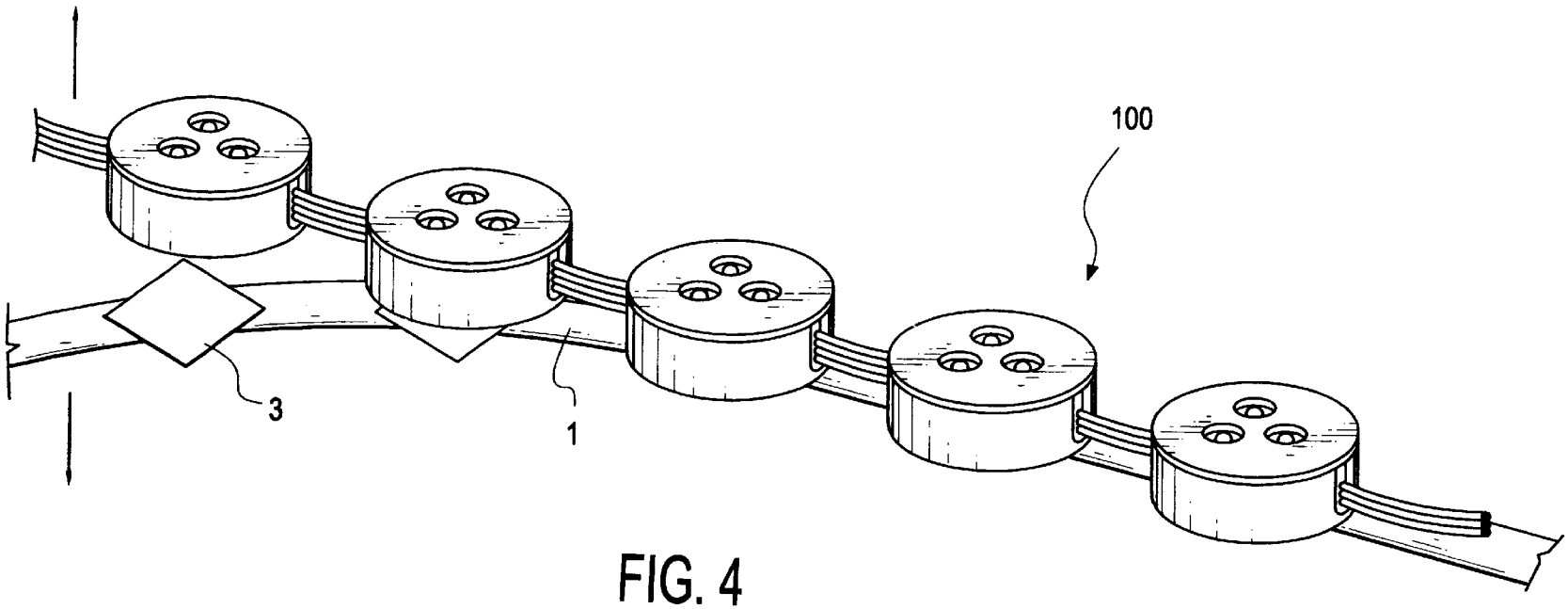
FIG. 4 is a schematic view showing the light string in accordance with the present invention is removed from a tape.

With reference to FIGS. 1 and 4, a light string in accordance with the present invention is composed of multiple light emitting units (100). Each light emitting unit (100) mainly comprises a base (10), a circuit board (20) and a cover plate (30).

The base (10) is formed with a bottom plate and a closed wall portion integrally formed around the circumference of the bottom plate, whereby a hollow (not numbered) is defined by the bottom plate and the wall portion for receiving the circuit board (20). Several positioning pillars (11) are formed on and extend from the bottom plate. Around the inner surface of the wall portion, several cannular columns (12) are integrally formed. A pair of U-shaped notches (13) are oppositely defined in the wall portion.

The circuit board (20) is installed with at least one emitting diode (LED) (21) thereon. The circuit board (20) is further defined with several through holes (22) corresponding to the positioning pillars (11) in the base (10), whereby the circuit board (20) is guided to arranged in the base (10) via the pillars (11) and the holes (22). In the present embodiment, three LEDs (21) with different colors are provided on the circuit board (20).

The cover plate (30) has a bottom surface where multiple positioning pins (31) extend downward to correspondingly insert into the cannular columns (12) of the base (10). The cover plate (30) is further defined with several openings (32) each of which corresponds to an LED (21) on the circuit board (20), whereby the light emitting from the LED is able to pass through the opening (32) and be visible.

Each circuit board (20) of each light emitting unit (100) is further connected sequentially via a signal bus (40), whereby the multiple light emitting units (100) are connected to form the light string. When the circuit board (20) is placed inside the base (10), the signal bus (40) is further securely clipped by two U-shaped buckles (41) and then each buckle (41) is retained in the respective U-shaped notch (13). The buckle (41) is designed to form multiple curved cuts to securely clip the signal bus (40).

Figure 2:
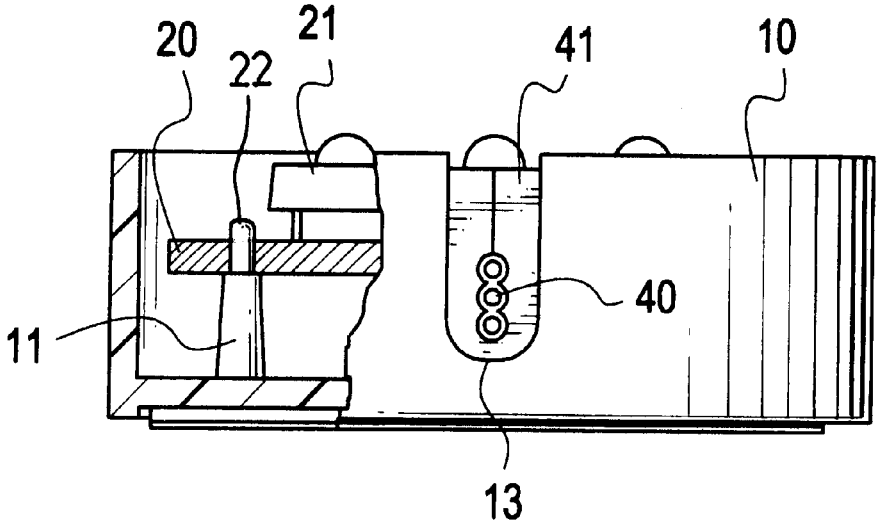
FIG. 2 is a partial cross-sectional view of the light emitting unit in accordance with the present invention.
Figure 3:
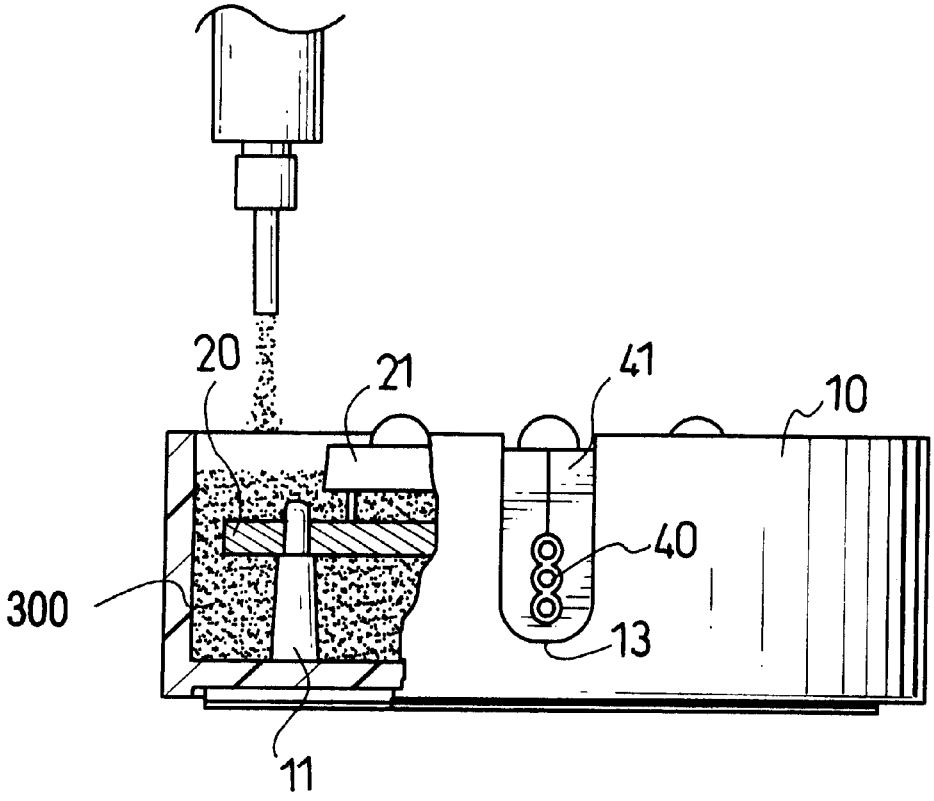
FIG. 3 is a schematic view showing the light emitting unit is filled with the waterproof glue.

With reference to FIG. 2, when the circuit board (20) is placed inside the base (10) and each positioning pillar (11) extends through the corresponding hole (22), the signal bus (40) is clipped by the buckles (41) that are fixed in the U-shaped notches (13). Thereafter, the base (10) is filled with the waterproof glue (300) (as shown in FIG. 3). After the waterproof glue (300) is solidified, the cover plate (30) (not shown) is mounted on the base (10), wherein each positioning pin (31) extends downward to insert into the respective cannular column (12) of the base (10).

With reference to FIGS. 1 and 4, when each light emitting unit (100) is completely assembled, the bottom of each base (10) is further adhered with a piece of a double sided tape (2). A tape (1), which is the common single sided tape, is further provided to stick the detachable paper (3) of each double sided tape (2) piece. When the light string of the present invention is practically applied to form any particular configuration, an operator just needs to tear the tape (1) away from the light string, whereby each detachable paper (3) of the double sided tape (2) is removed. Only the double sided tapes (2) remain on the bottom of the base (10).

Figure 5B:
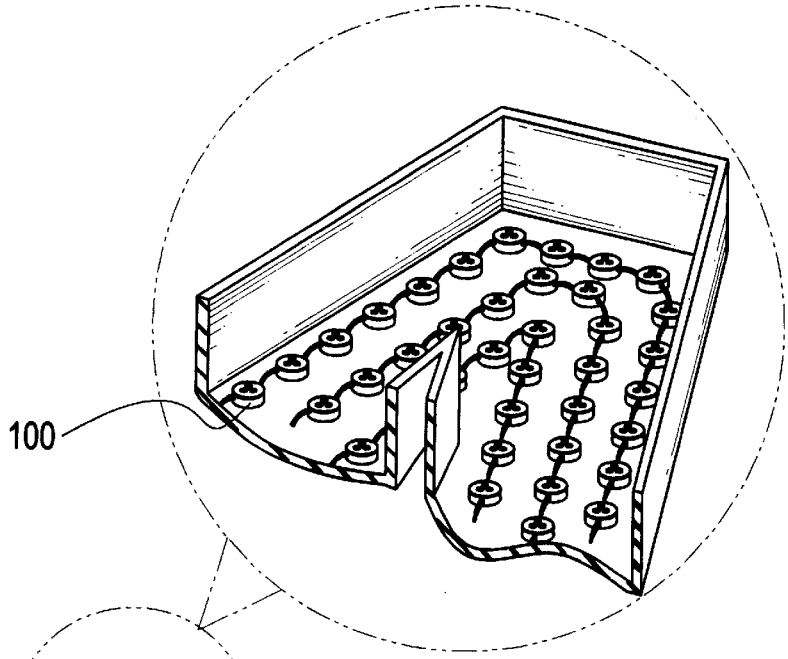
FIG. 5B is an enlarged view in part of the advertising device of FIG. 5A.
Figure 5A:
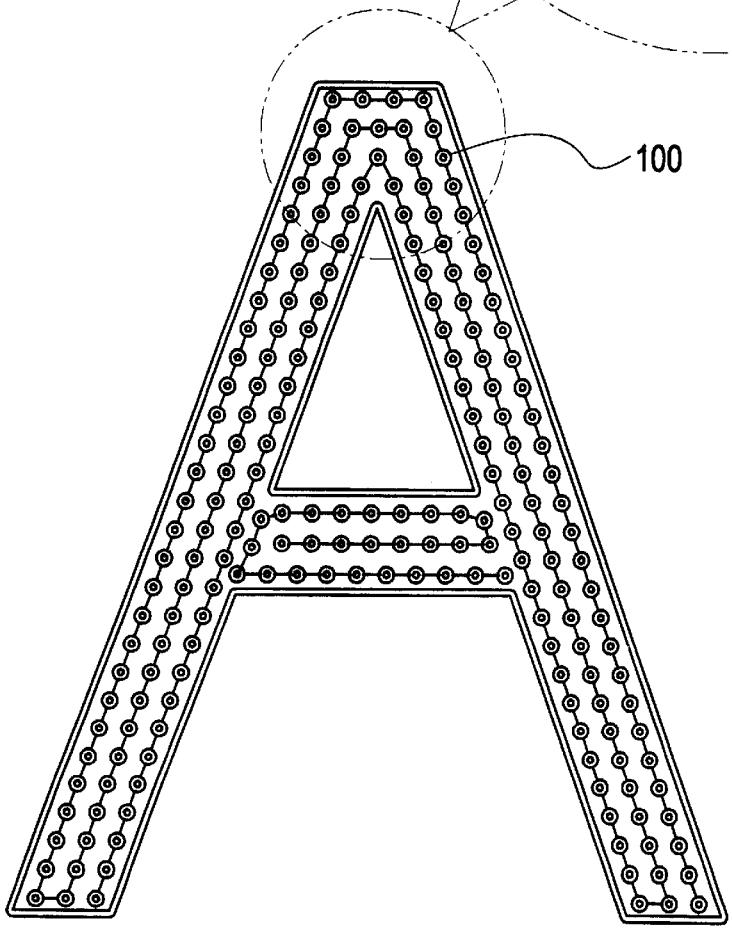
FIG. 5A is a plan view of an advertising device that composed of the light string in accordance with the present invention.

With reference to FIG. 5, when the adhesive tape (1) is removed from the light string, the light string can be adhered to form a particular configuration, such as an A-shaped advertising device. For example, the advertising device as shown in FIG. 5A and 5B is composed of two light strings in accordance with the present invention.

Figure 6:
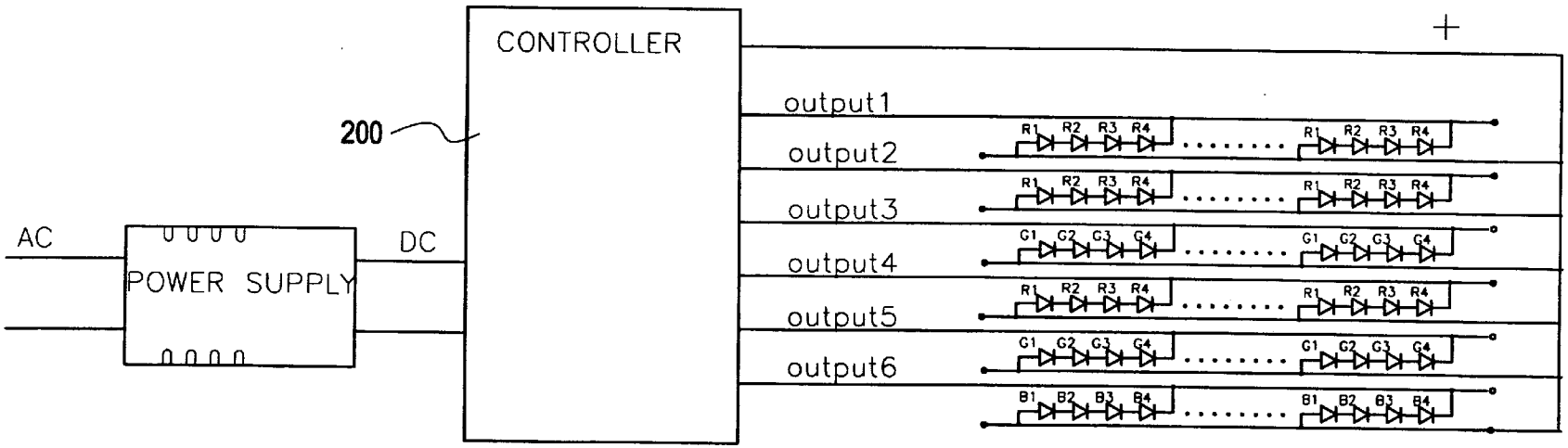
FIG. 6 is a control circuit showing a controller is applied to activate multiple light strings in accordance with the present invention.
Figure 7:
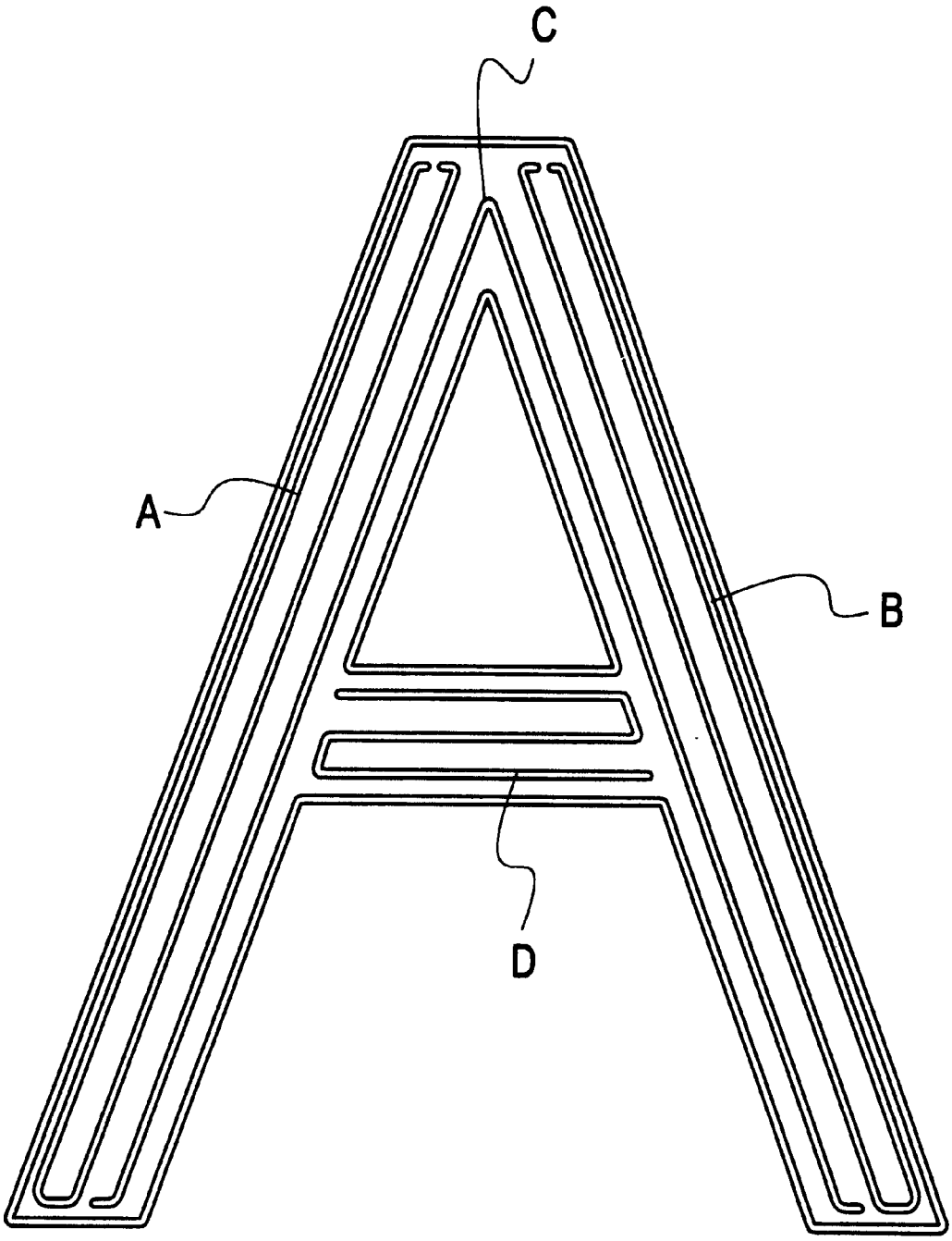
FIG. 7 PRIOR ART
FIG. 7 is a plan view of a conventional advertising device.

With reference to FIG. 6, in the practical application, a single advertising device may consist of multiple light strings. Thus a controller (200) with multiple output terminals is applied to link the multiple light strings and to control the activation of each light string. By determining the control signals output from the controller (200), the multiple light strings can be controlled to show different visual effects.

From the foregoing description of the embodiment, since the light string in accordance with the present invention is composed of LEDs and not the neon tubes, the use of the voltage transformer is omitted. Thus, the production cost for the advertiser is greatly reduced, moreover, the danger from the high voltage found in prior art is eliminated. Furthermore, an operator is able to use the light string of the present invention to form any particular configuration to increase the variety of visual effects.

The invention may be varied in many ways by a skilled person in the art. Such variations are not to be regarded as a departure from the spirit and scope of the invention, and all such modifications are intended to be included within the scope of the following claims.

What is claimed is:

1. A light string comprising:

multiple light emitting units sequentially connected to form the light string, wherein each light emitting unit comprises:

a base that is composed of a bottom plate and a wall portion upwardly formed around a circumference of the bottom plate, whereby a hollow is defined by the bottom plate and the wall portion;

a circuit board received in the hollow of the base, wherein at least one light emitting diode is installed on the circuit board as a light emitting source; and a cover plate mounted on the base, wherein the cover plate is defined with at least one opening corresponding to the at least one light emitting diode on the circuit board, thus the light generating by the light emitting diode is able to pass through the at least one opening.

2. The light string as claimed in claim 1, wherein a bus wire is provided to sequentially connect each circuit board of each light emitting unit.

3. The light string as claimed in claim 2, wherein each bottom plate of each base is adhered with a piece of a doubled to side tape.

4. The light string as claimed in claim 3, wherein each base is filled with waterproof glue in the hollow.

5. The light string as claimed in claim 4, wherein multiple holes are defined in the circuit board, and multiple positioning pillars are formed on and extend upwardly from the bottom plate of the base to correspondingly insert through the multiple holes.

6. The light string as claimed in claim 5, wherein multiple cannular columns are integrally formed around an inner surface of the wall portion of the base, and the cover plate with a bottom surface where multiple positioning pins extend to correspondingly insert into the multiple cannular columns.

7. The light string as claimed in claim 6, wherein a pair of U-shaped notches area oppositely defined in the wall portion of each base, and the signal bus is further, clipped by buckles that are securely received in the notches.

8. The light string as claimed in claim 7, wherein each buckle is formed to a substantial U shape and defined with multiple curved cuts to securely clip the signal bus.

9. The light string as claimed in claim 7, wherein a tape is provided to adhere each base of the multiple light emitting units, wherein the tape is adhered to a detachable paper of each double sided tape piece.

10. The light string as claimed in claim 1, wherein a controller is connected to a signal bus to control the light string.

11. The light string as claimed in claim 7, wherein a controller is connected to the signal bus to control the light string.

12. The light string as claimed in claim 8, wherein a controller is connected to the signal bus to control the light string.

13. The light string as claimed in claim 9, wherein a controller is connected to the signal bus to control the light string.

* * * * *